US006969040B2

(12) United States Patent
Williams

(10) Patent No.: US 6,969,040 B2
(45) Date of Patent: Nov. 29, 2005

(54) FORMER FOR A REINFORCED CONCRETE SLAB

(76) Inventor: Ion Muirhead Williams, 265 5th Street, Voelklip 7200, Hermanus (ZA)

( * ) Notice: Subject to any disclaimer, the term of this patent is extended or adjusted under 35 U.S.C. 154(b) by 0 days.

(21) Appl. No.: 10/415,534

(22) PCT Filed: Sep. 28, 2001

(86) PCT No.: PCT/IB01/01786

§ 371 (c)(1),
(2), (4) Date: Jun. 30, 2003

(87) PCT Pub. No.: WO02/27119

PCT Pub. Date: Apr. 4, 2002

(65) Prior Publication Data

US 2004/0172890 A1 Sep. 9, 2004

(30) Foreign Application Priority Data

Sep. 29, 2000 (ZA) ..... 2000/5277

(51) Int. Cl.[7] ..... E04G 11/42; E04G 11/44
(52) U.S. Cl. ..... 249/23; 249/31; 249/211
(58) Field of Search ..... 249/19, 23, 24, 249/28, 30, 31, 211; 52/321, 322, 323, 326

(56) References Cited

U.S. PATENT DOCUMENTS

| | | | | |
|---|---|---|---|---|
| 893,328 | A * | 7/1908 | King | 249/24 |
| 938,718 | A * | 11/1909 | Smith | 249/211 |
| 1,209,391 | A * | 12/1916 | Brynoldt | 249/24 |
| 1,363,391 | A * | 12/1920 | Carpenter | 249/30 |
| 1,627,171 | A * | 5/1927 | Gottschalk | 249/19 |
| 1,830,606 | A * | 11/1931 | Kandle | 249/24 |
| 2,093,401 | A | 9/1937 | Carilli | |
| 3,674,232 | A * | 7/1972 | Varlonga | 249/23 |
| 4,957,269 | A * | 9/1990 | Villarreal | 249/24 |

FOREIGN PATENT DOCUMENTS

DE 25 13 070 10/1976

(Continued)

*Primary Examiner*—Michael Safavi
(74) *Attorney, Agent, or Firm*—Kilpatrick Stockton LLP

(57) ABSTRACT

The invention provides for a removable former which is interlockable with other, similar formers between spaced-apart ribs to form shuttering between the ribs for a reinforced concrete slab. The former includes a hollow block (110) which has a top face (112), a front face (114), a rear face, two opposed side faces (116) and an interlocking flange (118) on or below each of the side faces for interlocking the hollow block, side by side, with adjacent, similar hollow blocks. The interlocking flanges (118) extend from the side faces (116) so that when the hollow block is interlocked with an adjacent hollow block, a gap is formed between adjacent side faces of the interlocked blocks. The former also includes a support member (122) for supporting the hollow block (110) on two of the spaced-apart ribs during casting of the concrete slab. The support member (122) includes a pair of connectors (124) which are arranged to connect the support member to the front and rear faces of the hollow block (110) and to extend outwardly from the front and rear faces for engaging the two ribs during casting of the concrete slab. The support member (122) also includes two restraining limbs (128) which are connectable to one another for restraining inward displacement of the connectors and hence the front and rear faces of the hollow block (110) during casting of the concrete slab. A plurality of openings (134) are provided for drawing the connectors (124) off the ribs after the concrete has set.

12 Claims, 4 Drawing Sheets

FOREIGN PATENT DOCUMENTS

| | | |
|---|---|---|
| FR | 1 007 698 | 5/1952 |
| FR | 1 193 383 | 11/1959 |
| FR | 1 270 708 | 9/1961 |
| GB | 1 266 349 | 3/1972 |

* cited by examiner 110
126
129
134
134
128
131
132
124
112
118
114
130
116
132
128
134
131
126
134
118
120
122
124

134
7
124
134
7
118
128
118
120
120
128
134
124

FORMER FOR A REINFORCED CONCRETE SLAB

BACKGROUND OF THE INVENTION

This invention relates to a former for a reinforced concrete slab. More specifically, the invention relates to a removable former which is interlockable with other, similar formers between spaced-apart ribs to form shuttering between the ribs for a reinforced concrete slab.

Various different methods for forming reinforced concrete slabs exist. In block-and-rib type methods, the slab is formed by spanning a plurality of spaced-apart, steel reinforced, precast concrete ribs between vertical support members, placing filler blocks on top of the ribs so as to span across the gaps between adjacent ribs, locating additional steel reinforcing over and/or between the blocks, and casting concrete over the ribs and blocks.

Typically, the filler blocks are formed from a cementitious material such as a cement and sand mix. These blocks are normally relatively heavy and tend to be difficult to handle and transport. Furthermore, if the slab requires steel reinforcing which spans in two transverse directions, it is usually necessary to space the blocks from one another along the lengths of the ribs so as to accommodate the additional steel reinforcing. The openings defined between the spaced-apart blocks have to be closed off with additional shuttering before the concrete can be cast, and the erection of this additional shuttering usually involves a substantial amount of extra work and often is relatively time consuming. Another drawback associated with conventional filler blocks for block-and-rib reinforced concrete slabs is that they are incorporated into the slab during casting of the concrete and cannot be removed for subsequent re-use.

It is an object of the present invention to provide a removable former which can be used together with other, similar formers instead of filler blocks in a block-and-rib type reinforced concrete slab, which is interlockable with adjacent formers so as to allow steel reinforcing to span in two transverse directions between the formers without the need for any additional shuttering, and which is easy to handle and transport.

SUMMARY OF THE INVENTION

According to the invention there is provided a removable former which is interlockable with other, similar formers between spaced-apart ribs to form shuttering between the ribs for a reinforced concrete slab, the former comprising:

- a hollow block which includes a top face, a front face, a rear face, two opposed side faces and an interlocking formation on or below each of the side faces for interlocking the hollow block, side by side, with adjacent, similar hollow blocks, the interlocking formations extending from the side faces so that when the hollow block is interlocked with an adjacent hollow block, a gap is formed between adjacent side faces of the interlocked blocks; and
- a support member for supporting the hollow block on two of the spaced-apart ribs during casting of the concrete slab, the support member including:
  - a pair of connectors for connecting the support member to the front and rear faces of the hollow block, the connectors being arranged to extend outwardly from the front and rear faces and to engage the two ribs during casting of the concrete slab,

- at least one restraining member for restraining inward displacement of the connectors and hence the front and rear faces of the hollow block during casting of the concrete slab, and
  - one or more formations for drawing the connectors off the ribs after the concrete has set.

In a preferred embodiment of the invention, the connectors comprise a pair of rails defining engagement formations on upper surfaces thereof for engaging the lower surfaces of the front and rear faces of the hollow block, and the at least one restraining member comprises two limbs which are connectable to one another to form a link between the rails.

In a particularly preferred embodiment, each limb is pivotally connected to one of the rails so as to be movable between an operative position in which it extends transversely with respect to the rail with one end projecting Into the engagement formation on the rail for locking the rail to the front or rear face of the hollow block, and an inoperative position in which the limb is withdrawn from the engagement formation on the rail. In this case, the front and rear faces may define recesses or apertures for receiving the ends of the restraining limbs when these limbs are In the operative position.

The one or more formations for drawing the connectors off the ribs may comprise at least one opening in each rail which is sized to receive a lever.

In another form of the invention, the support member comprises a plate which is fixed to the connectors. In this embodiment, the front and rear faces of the hollow block may include clipping formations which are designed to clip into corresponding formations on the connectors.

The plate may include an opening, typically a slot, which is sized to receive a tool for deforming the plate after the concrete has set thereby to draw the connectors off the ribs.

The interlocking formations may comprise outwardly extending, U-shaped lips which are designed to receive or fit into corresponding U-shaped lips on adjacent, similar formers. In this case, the U-shaped lips may be located below the side faces of the hollow block.

Alternatively, the interlocking formations may comprise outwardly extending flanges which are connectable to one another which fasteners.

Typically, the hollow block is open along the bottom so as to form a cavity, and tapers Inwardly towards the top face of the block so that a plurality of blocks can be stacked one above the other to facilitate the handling and transportation of the blocks prior to use.

Conveniently, the hollow block and the support member are moulded or extruded from a plastics material.

For the purpose of this specification, terms such as front, rear, top, bottom, and the like when referring to the removable former of the invention are to be interpreted with the former in an operative orientation.

BRIEF DESCRIPTION OF THE DRAWINGS

The invention will now be described in more detail, by way of example only, with reference to the accompanying drawings in which.

DESCRIPTION OF THE PREFERRED EMBODIMENTS

Figure 1:
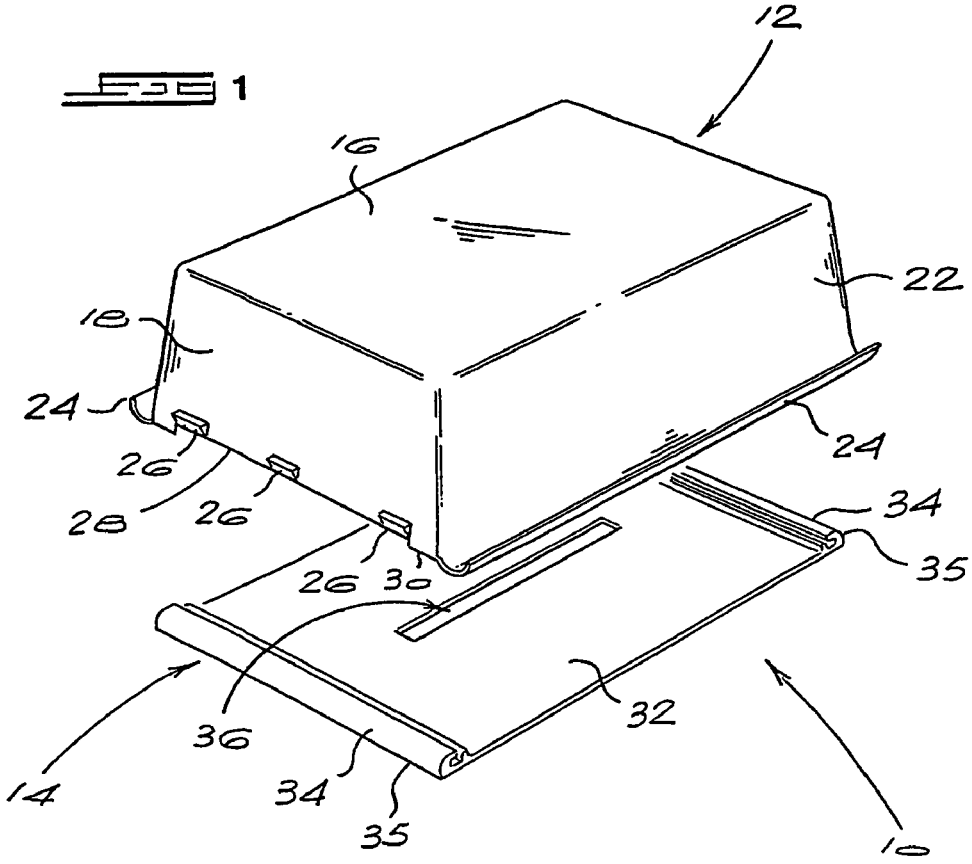
FIG. 1 shows an exploded, perspective view of a removable former according to the present invention.

FIG. 1 of the drawings illustrates a removable former according to the present invention in an unassembled form. The former is designated generally with the reference numeral 10 and includes a hollow block 12 and a support member 14.

The block 12 has a top face 16, a front face 18, a rear face (not visible), and two opposed side faces 22 (only one of which is visible). The front, rear and side faces are inclined, as shown, so that the block 12 tapers inwardly towards the top face, and the bottom of the block is open so as to provide access into a stacking cavity in the block. The stacking cavity is sized and shaped so that a plurality of the blocks can be placed one inside the other to facilitate the handling and transportation of the blocks prior to use.

The lower end of each side face 22 carries an interlocking formation in the form of a U-shaped lip 24. These formations are arranged to engage with corresponding interlocking formations on adjacent, similar blocks (not illustrated) so as to connect the block 12 to adjacent hollow blocks.

In FIG. 1, the front face 18 is seen to include three clipping formations 26 which jut out from the outer surface of this face above a recessed portion 28 in a lower edge 30 of the front face. The rear face also includes three clipping formations above a recessed portion in the lower edge of this face.

Figure 2:
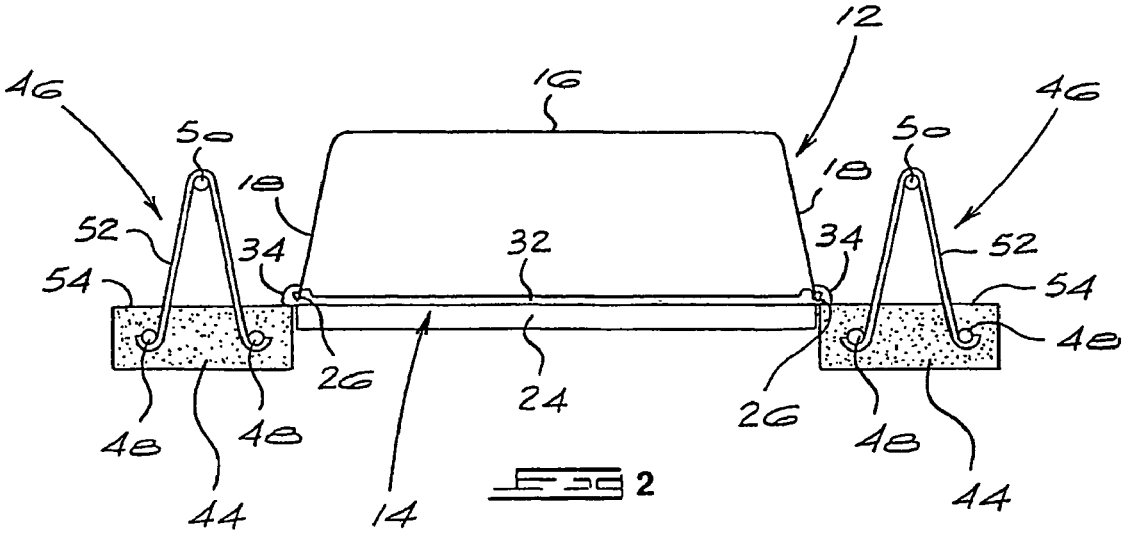
FIG. 2 shows a cross-sectional view of the former of the invention located between two spaced-apart, precast concrete ribs to form shuttering between the ribs for a reinforced concrete slab.
Figure 3:
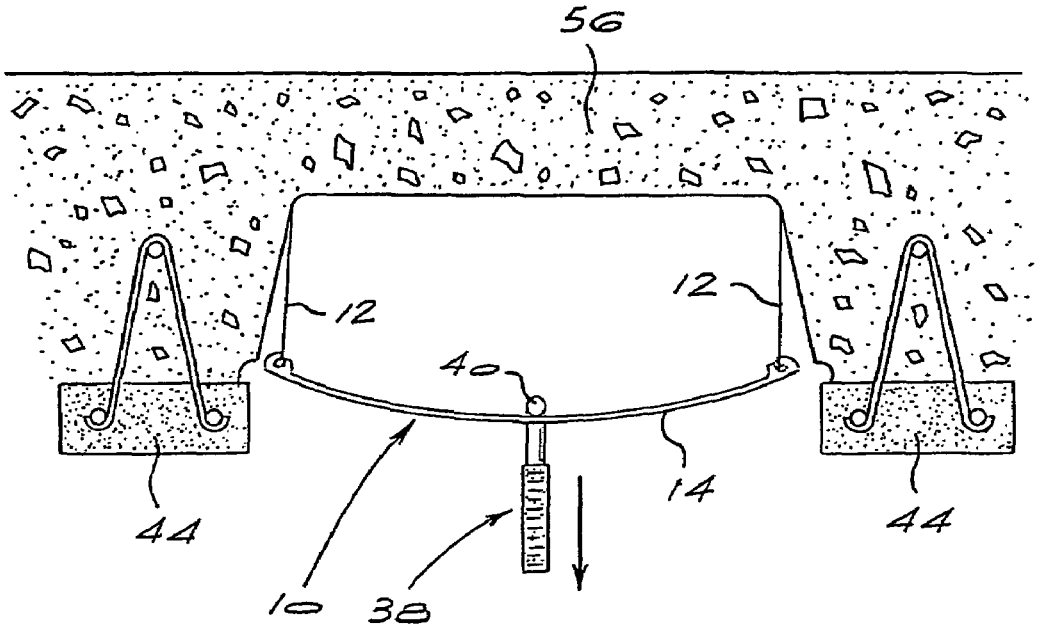
FIG. 3 shows a cross-sectional view similar to that of FIG. 2 during the removal of the former from a cast concrete slab.
Figure 4:
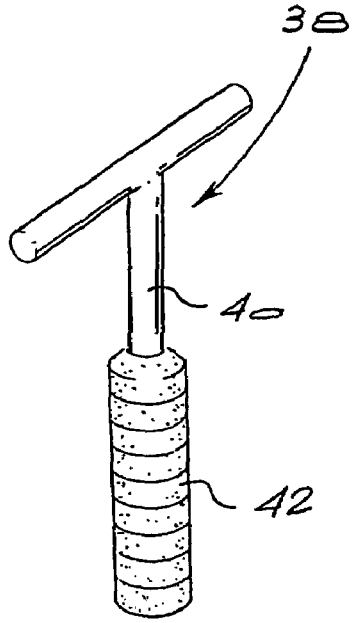
FIG. 4 shows a perspective view of a tool for removing the former from a cast concrete slab.

The support member 14 Illustrated in FIGS. 1 to 3 of the drawings comprises a plate 32 and two connectors In the form of clipping formations 34 along sides 35 thereof. The clipping formations 34 are designed to receive the clips 26 on the front and rear faces of the block 12 so as to connect the lower edges of these faces to the support member. The plate 32 also defines a slot 36 which is specifically designed to receive a tool 38 (see FIG. 4) having a T-shaped shank 40 and a handle 42.

Both the block 12 and the support member 14 are formed from a plastics material so as to be relatively lightweight. In this embodiment, the hollow block is formed in an injection moulding process and the support member is formed in an extrusion process.

In practice, a plurality of formers 10 are used instead of filler blocks in a block-and-rib type method of forming a reinforced concrete slab. To form the slab, the support members 14 are clipped onto the blocks 12 by engaging the clipping formations 26 on the front and rear faces of the blocks with the formations 34 on the support members, and each former 10 is then placed over a pair of spaced-apart, precast concrete ribs 44 so as to span the gap between the ribs, as illustrated in FIG. 2. The ribs 44 are supported in a conventional manner and are seen to include steel reinforcing 46 which is partially embedded within the ribs and partially exposed above the ribs. The reinforcing 46 is of a conventional type and includes two lower reinforcing bars 48 within each rib, and one upper reinforcing bar 50 above each rib which is spaced from the lower bars by a spacer 52.

The support members 14 bear against the upper surface 54 of each rib 44, as shown, so that the blocks 12 are supported above the ribs, and the hollow blocks are connected to one another, side by side, by means of the interlocking formations 24. In this way, the formers 10 extend along the lengths of the ribs 44 and form continuous shuttering between the ribs.

With the formers in place, additional steel reinforcing, for example wire mesh or additional transversely extending steel reinforcing bars, is placed on top of and/or between the blocks 12, and concrete (not shown) is cast over the formers and the ribs to form a reinforced concrete slab. If desired, a conventional shutter oil may be applied to the outer surfaces of the blocks 12 prior to casting the concrete.

Once the concrete has set (see FIG. 3), the formers are removed from the slab 56 with the tool 38. FIG. 3 illustrates one of the formers 10 in a partially removed condition in which the shank 40 of the tool 38 has been inserted through the slot 36 in the plate 32 and has been rotated through 90° so as to be captured within the former. With the upper portion of the shank 40 above the plate 32, the tool 38 is pulled downwardly so as to deform the support member in the manner illustrated in FIG. 3. When this occurs, the front and rear faces of the block 12 are drawn away from the concrete slab 56 so that the former 10 can be pulled down between the ribs 44 away from the soffit of the slab for subsequent re-use.

Figure 5:
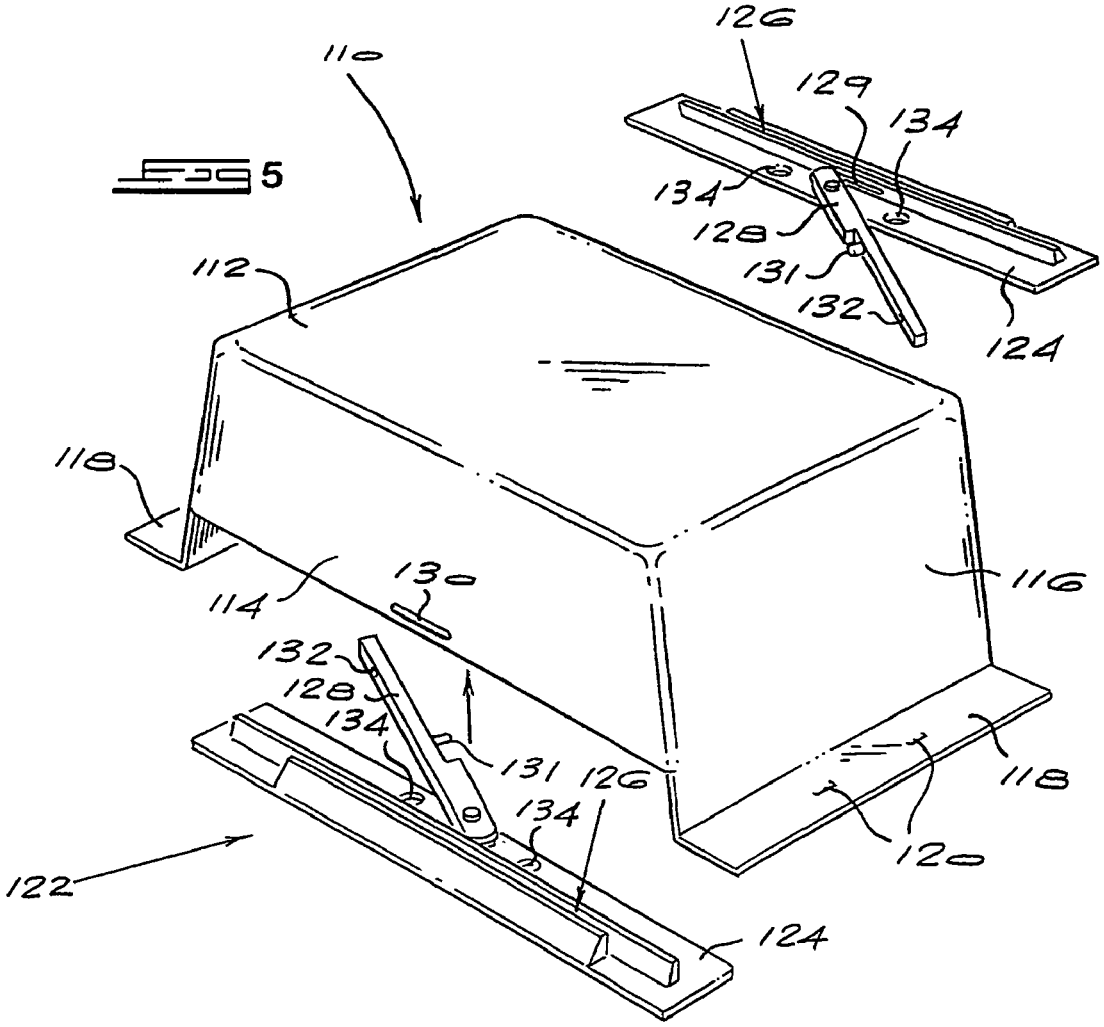
FIG. 5 shows an exploded, perspective view of a removable former according to another embodiment of the invention with a support member in an inoperative condition.

FIG. 5 of the drawings illustrates another embodiment of the former according to the present invention. In this embodiment, the hollow block 110 with top face 112, front face 114, rear face (not visible) and opposed side faces 116 (only one of which is visible) includes interlocking formations In the form of two flanges 118 which extend outwardly from extended portions of the side faces 116, as shown. Each flange 118 defines a pair of apertures 120 for fastening the flange to a similar flange on an adjacent former with fasteners (not shown).

As in the case of the previous embodiment, the side faces and the front and rear faces of the hollow block 110 slope inwardly towards the top face so that the block can be stacked above or below other, similar blocks.

Figure 6:
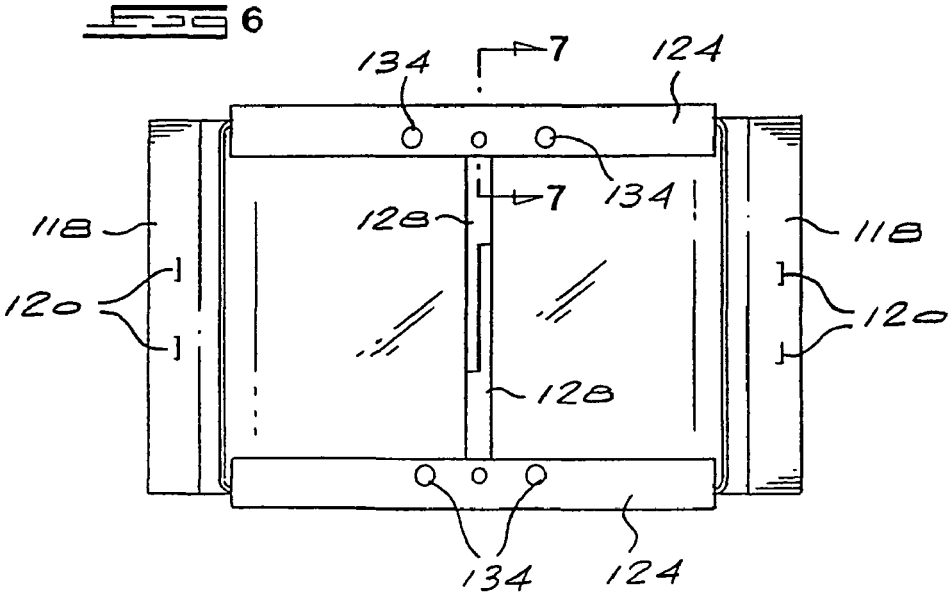
FIG. 6 shows the former of FIG. 5 from below with the support member in an operative condition.
Figure 7:
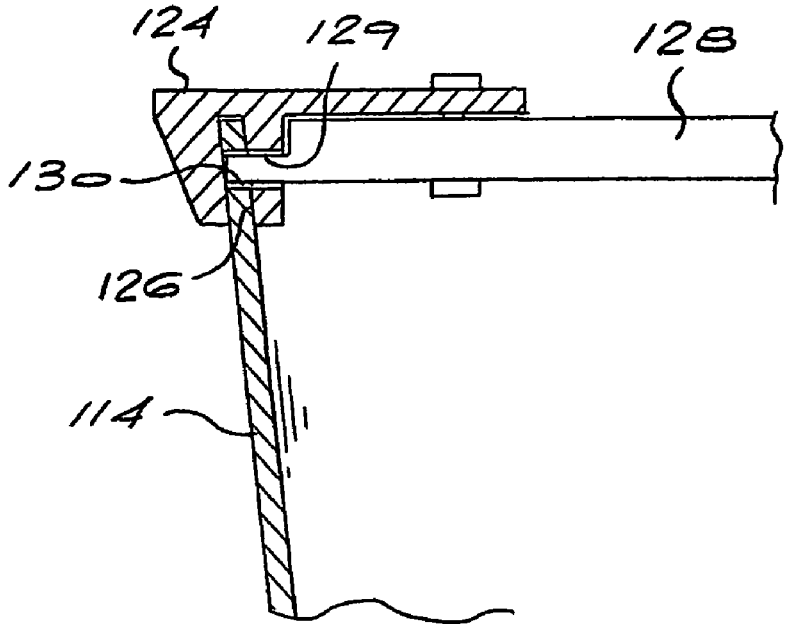
FIG. 7 shows a cross-sectional view along the line 7—7 in FIG. 6.
Figure 8:
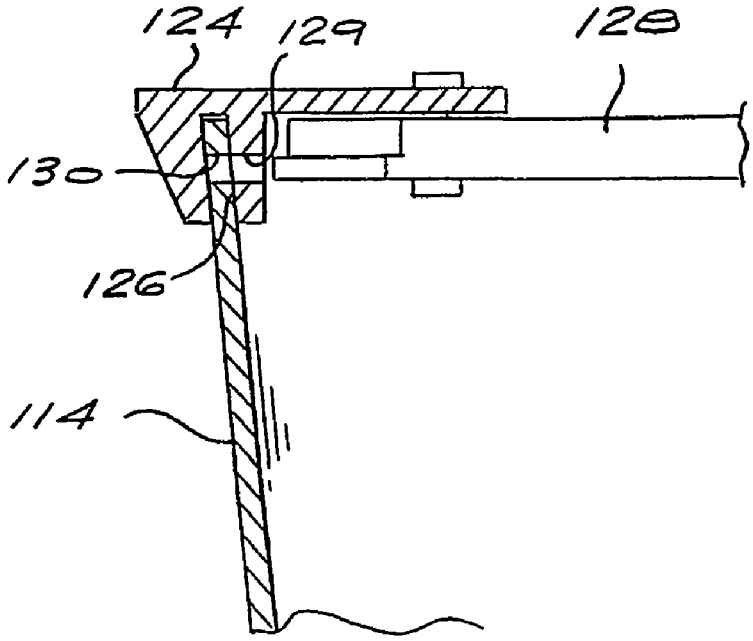
FIG. 8 shows a cross-sectional view similar to that of FIG. 7 with the support member In an inoperative condition.

The support member 122 in this embodiment includes two rails 124 defining engagement slots 126 on upper surfaces thereof for engaging the lower edges of the front and rear faces on the hollow block 110. With reference also to FIGS. 6 to 8 of the accompanying drawings, a limb 128 is pivotally connected to each of the rails so as to be movable between an operative position (illustrated in FIGS. 6 and 7) in which the end of the limb projects into the slot 126 through an opening 129, and an inoperative position in which the limb is withdrawn from the slot (as shown in FIGS. 5 and 8). Each of the front and rear faces include an opening 130 for receiving the end of one of the limbs 128 when the limb is in the operative position. In this way, the limbs 128 extend through the front and rear faces of the block 110 and through the rails 124 to lock the rails to the hollow block in a manner which is illustrated most clearly in FIG. 7.

The limbs 128 are also connectable to one another by locating connecting projections 131 on the limbs in corresponding connecting openings 132 (see FIGS. 5 and 6). In the FIG. 6 condition of the former, the rails 124 are seen to be held apart by the limbs 128 and are restrained from moving towards one another by the limbs. In this condition, the rails are placed onto two spaced-apart ribs (which may be precast concrete or rolled steel ribs) in a similar manner to that described above with reference to the first embodiment of the invention so that the hollow block 110 is supported above the ribs, and the interlocking flanges 118 of adjacent formers are fastened together to form shuttering for a concrete slab between the ribs.

Once concrete cast over the shuttering has set, a lever (not shown) is inserted into openings 134 in the rails 124 and the rails are prised off the ribs so as to allow the hollow blocks 110 to be removed from the soffit of the slab for subsequent use.

In both embodiments of the invention, the support member locates the hollow block on the ribs prior to casting of the concrete slab and provides lateral support to the front and rear faces during casting.

One advantage of the removable former according to the present invention is that it is fairly lightweight when compared with conventional filler blocks for block-and-rib type reinforced concrete slabs, and consequently is relatively easy to handle. Also, the fact that the hollow blocks can be stacked one above the other renders the former relatively easy to transport. Apart from this, the interlocking formations are designed to form a gap between the side faces of adjacent, interlocked blocks and this allows for steel reinforcing to span In two transverse directions without the need for any additional shuttering. Furthermore, since the support member allows the former to be removed from the soffit of a reinforced concrete slab after the concrete has set, the former can be retained for subsequent use in other reinforced concrete slabs.

What is claimed is:

1. A removable former which is interlockable with other, similar formers between spaced-apart ribs to form shuttering between the ribs for a reinforced concrete slab, the former comprising:

a hollow block which includes a top face, a front face, a rear face, two opposed side faces and an interlocking formation on or below each of the side faces for interlocking the hollow block, side by side, with adjacent, similar hollow blocks, the interlocking formations extending from the side faces so that when the hollow block is interlocked with an adjacent hollow block, a gap is formed between adjacent side faces of the interlocked blocks; and a support member for supporting the hollow block on two of the spaced-apart ribs during casting of the concrete slab, the support member including:

a pair of connectors for connecting the support member to the front and rear faces of the hollow block, wherein the connectors define clipping formations for engaging corresponding clipping formations on the front and rear faces of the hollow block, and wherein the connectors are arranged to extend outwardly from the front and rear faces for engaging the two ribs during casting of the concrete slab, at least one restraining member for restraining inward displacement of the connectors and hence the front and rear faces of the block during casting of the concrete slab, wherein the at least one restraining member comprises a plate which is fixed to the connectors, and one or more formations for drawing the connectors off the ribs after the concrete has set.

2. A removable former according to claim 1, wherein the plate includes an opening which is sized to receive a tool for deforming the plate after the concrete has set thereby allowing the connectors to be drawn off the ribs.

3. A removable former according to claim 1, wherein the interlocking formations comprise outwardly extending, U-shaped lips which are designed to receive or fit into corresponding U-shaped lips on adjacent, similar formers.

4. A removable former according to claim 2, wherein the U-shaped lips are located below the side faces of the hollow block.

5. A removable former according to claim 1, wherein the hollow block is open along the bottom so as to form a cavity, and tapers inwardly towards the top face of the block so that a plurality of blocks can be stacked one above the other.

6. A removable former according to claim 1, wherein the hollow block and the support member are formed from a plastics material.

7. A removable former which is interlockable with other, similar formers between spaced-apart ribs to form shuttering between the ribs for a reinforced concrete slab, the former comprising:

a hollow block which includes a top face, a front face, a rear face, two opposed side faces and an interlocking formation on or below each of the side faces for interlocking the hollow block, side by side, with adjacent, similar hollow blocks, the interlocking formations extending from the side faces so that when the hollow block is interlocked with an adjacent hollow block, a gap is formed between adjacent side faces of the interlocked blocks; and a support member for supporting the hollow block on two of the spaced-apart ribs during casting of the concrete slab, the support member including:

a pair of connectors for connecting the support member to the front and rear faces of the hollow block, wherein the pair of connectors comprise rails which define engagement formations on upper surfaces thereof for engaging the lower surfaces of the front and rear faces of the hollow block, and wherein the rails are arranged to extend outwardly from the front and rear faces for engaging the two ribs during casting of the concrete slab, at least one restraining member for restraining inward displacement of the rails and hence the front and rear faces of the block during casting of the concrete slab, wherein the at least one restraining member comprises two limbs which are connectable to one another to form a link between the rails, and wherein each limb is pivotally connected to one of the rails so as to be movable between an operative position in which it extends transversely with respect to the rail with one end projecting into the engagement formation on the rail for locking the rail to the front or rear face of the hollow block, and an inoperative position in which the limb is withdrawn from engagement formation on the rail, and one or more formations for drawing the connectors off the ribs after the concrete has set.

8. A removable former according to claim 1, wherein the front and rear faces define recesses or apertures for receiving the ends of the restraining limbs when the limbs are in the operative position.

9. A removable former according to claim 1, wherein the one or more formations for drawing the connectors off the ribs comprises at least one opening in each rail which is sized to receive the end of a lever.

10. A removable former according to claim 1, wherein the interlocking formations comprise outwardly extending flanges which are connectable to one another with fasteners.

11. A removable former according to claim 1, wherein the hollow block is open along the bottom so as to form a cavity, and tapers inwardly towards the top face of the block so that a plurality of blocks can be stacked one above the other.

12. A removable former according to claim 1, wherein the hollow block and the support member are formed from a plastics material.

* * * * *